United States Patent [19]

Teague et al.

[11] 4,266,948

[45] May 12, 1981

[54] FIBER-REJECTING CORONA DISCHARGE ELECTRODE AND A FILTERING SYSTEM EMPLOYING THE DISCHARGE ELECTRODE

[75] Inventors: Richard K. Teague; Henry H. S. Yu, both of Winston-Salem, N.C.

[73] Assignee: Envirotech Corporation, Menlo Park, Calif.

[21] Appl. No.: 109,695

[22] Filed: Jan. 4, 1980

[51] Int. Cl.[3] ..... B03C 3/12; B03C 3/14; B03C 3/41

[52] U.S. Cl. ..... 55/126; 55/131; 55/138; 55/152

[58] Field of Search ..... 55/124, 126, 129, 131, 55/138, 149, 150, 152, 155

[56] References Cited

U.S. PATENT DOCUMENTS

| | | | |
|---|---|---|---|
| 2,279,583 | 4/1942 | Slayter | 55/124 |
| 2,295,152 | 9/1942 | Bennett | 55/138 |
| 2,327,588 | 8/1943 | Bennett | 55/152 |
| 2,364,641 | 12/1944 | Meston | 55/129 |
| 3,375,638 | 4/1968 | Dungler | 55/131 |
| 3,461,882 | 8/1969 | Epstein et al. | 55/131 |
| 3,500,614 | 3/1970 | Soo | 55/149 |
| 4,133,652 | 1/1979 | Ishikawa et al. | 55/138 |

FOREIGN PATENT DOCUMENTS

| | | | |
|---|---|---|---|
| 215121 | 2/1957 | Australia | 55/131 |
| 1078096 | 3/1960 | Fed. Rep. of Germany | 55/131 |
| 454598 | 1/1966 | Japan | 55/124 |

*Primary Examiner*—David L. Lacey

*Attorney, Agent, or Firm*—Robert E. Krebs; Thomas J. McNaughton

[57] ABSTRACT

In a system for filtering fibers and particulates from a gas stream, a fiber separator (10) is disposed to remove fibers in gross quantity from the gas stream. A corona charging apparatus (20) is disposed downstream of the fiber separator (10) to impart electric charge to particulates and to fibers that escape removal from the gas stream by the fiber separator (10). An electrostatic filter medium (30), which may advantageously be mounted on the cylindrical wall of a drum filter, is disposed downstream of the corona charging apparatus (20) to remove electrically charged particulates and fibers from the gas stream. The corona charging apparatus (20) comprises at least one fiber-rejecting corona discharge electrode (21 or 25). The fiber-rejecting electrode (21) comprises a shielding portion (22) facing upstream and a corona discharge portion (23) facing downstream in the gas stream. The radius of curvature of the shielding portion (22) is greater than the radius of curvature of the corona discharge portion (23) in a plane parallel to the gas stream so that the corona discharge occurs in a region that is shielded from fibers carried by the gas stream.

20 Claims, 7 Drawing Figures

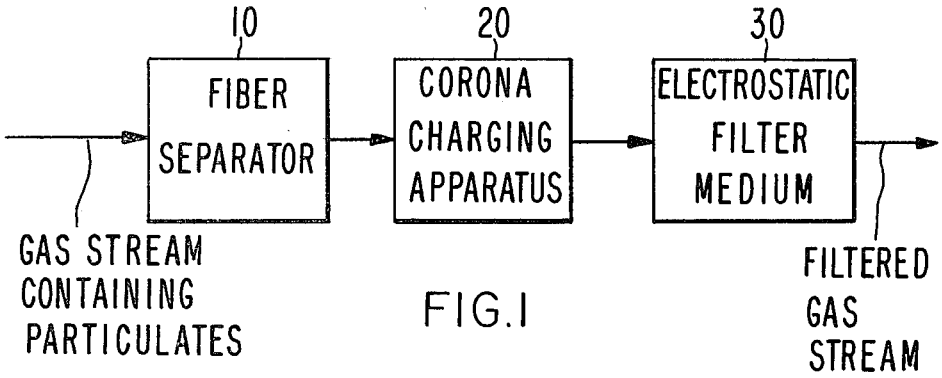
FIG.1
FIG.2
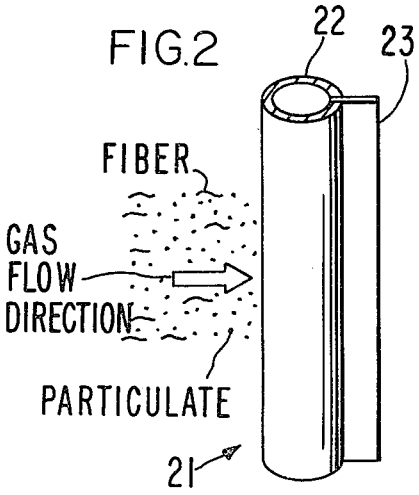
FIG.3
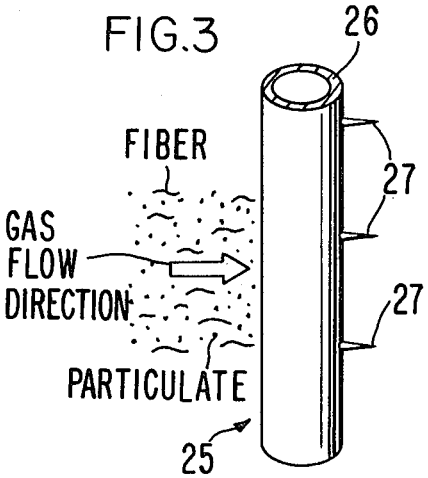
FIG.2A
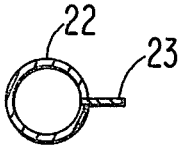
FIG.3A
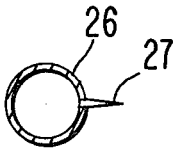
FIG.2B
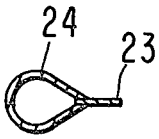
FIG.3B
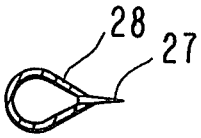

FIBER-REJECTING CORONA DISCHARGE ELECTRODE AND A FILTERING SYSTEM EMPLOYING THE DISCHARGE ELECTRODE

BACKGROUND OF THE INVENTION

1. Field of the Invention

This invention pertains generally to the electrostatic filtration of particulates from a gas stream that contains both particulates and fibers.

More particularly, this invention pertains to corona discharge electrodes for imparting electric charge to particulates in a gas stream that contains both particulates and fibers.

2. State of the Prior Art

The term "particulates" is conventionally used to indicate aerosol particles having a longest dimension less than 100 microns. The term "fibers" is conventionally used to indicate aerosol particles having a length-to-diameter ratio greater than 10, with the length being in the $10^3$ to $10^4$ micron range.

In many industrial operations (e.g., the manufacture of textiles from cotton, wool or synthetic materials), particulates and fibers become entrained in gas streams such as streams of air for collecting dust and waste fibers in the vicinity of processing machines, or air that is circulated by air conditioning apparatus. In a typical filtration system as known in the prior art for removing particulates and fibers from a gas stream, a mechanical fiber separator is positioned in the gas stream to remove fibers from the gas stream in gross quantity. However, respirable particulates in the gas stream, which tend to be harmful to health, pass through the fiber separator to a significant extent, and remain in the gas stream until removed by some other technique.

As a practical matter, a mechanical fiber separator as used in a typical gas filtration system is considerably less than 100% effective in removing fibers from the gas stream. A typical technique for removing particulates and fibers that have escaped removal from the gas stream by a mechanical separator comprises imparting electric charge to the particulates and fibers downstream of the mechanical separator, and electrostatically attracting the charged particulates and fibers onto a filter medium.

A conventional technique for imparting electric charge to particulates in a gas stream uses a corona discharge electrode, or a plurality of corona discharge electrodes, positioned in the gas stream. Ordinarily, at least some fibers along with the particulates that pass through the fiber separator enter into the corona discharge region and become electrically charged. The gas stream then carries a major portion of the electrically charged fibers along with the electrically charged particulates to an electrostatic filter medium, where the charged fibers and particulates are removed from the gas stream by deposition onto the filter medium.

Corona discharge electrodes as used in imparting electric charge to particulates in the atmosphere of an industrial plant usually comprise fine wires of, e.g., 10-mil outside diameter. It has been found, however, that a significant portion of the electrically charged fibers in the gas stream become entangled on the corona-generating electrodes in the corona discharge region. Such entangled fibers tend to form a fibrous coating on the corona-generating electrodes.

When a coating of high-resistivity fibers builds up on the corona-generating electrodes of a gas filtration system, the voltage needed to maintain a desired rate of ion production in the corona discharge region can increase significantly. Raising the voltage to a level sufficient to maintain ion production in such circumstances, however, can cause sparking with the attendant danger of fire or explosion. Furthermore, the build-up of a fibrous coating on the corona-generating electrodes can significantly impede gas flow in certain types of gas filtration systems.

OBJECTS OF THE INVENTION

It is an object of the present invention to provide an apparatus having one or more corona-generating electrodes for imparting electric charge to particulates in a gas stream that contains both particulates and fibers, where the corona-generating electrodes are safeguarded against becoming coated with fibers drawn from the gas stream.

One or more corona-generating electrodes according to the present invention are mounted in the flow path of the gas stream upstream of an electrostatic filter medium, and (preferably) downstream of a mechanical fiber separator that can remove fibers from the gas stream in gross quantity. A corona-generating electrode according to the present invention is elongate, and has a shielding portion that faces into the gas stream and a corona discharge portion that is shielded from the gas stream by the shielding portion.

For a corona-generating electrode according to the present invention, the radius of curvature of the shielding portion is greater than the radius of curvature of the corona discharge portion in a cross-sectional plane parallel to the gas stream and perpendicular to the direction of elongation of the electrode. The perimeter around the electrode in that cross-sectional plane is sufficiently large so that fibers of less than a selected length cannot become entangled on the electrode. In many applications, the lengths of substantially all the fibers passing through a particular type of upstream fiber separator are within a relatively narrow range (e.g., within ±3000 microns of an average 6000-micron length for cotton fibers). Consequently, in many applications of the present invention, it is sufficient for the perimeter around the corona generating electrode to be greater than the average length of the fibers entrained in the gas stream.

DESCRIPTION OF THE DRAWING

FIG. 1 is a schematic depiction of a filtration system for removing fibers and particulates from a gas stream.

FIG. 2 is a fragmentary perspective view of one embodiment of an electrode according to the present invention, where the corona discharge portion is vane-like.

FIG. 2A is a cross-sectional view of the electrode shown in FIG. 2.

FIG. 2B is a cross-sectional view of a modification of the electrode shown in FIG. 2, where the shielding portion of the electrode is generally ovate.

FIG. 3 is a fragmentary perspective view of an alternative embodiment of an electrode according to the present invention, where the corona discharge portion comprises needle-like projections.

FIG. 3A is a cross-sectional view of the electrode shown in FIG. 3.

FIG. 3B is a cross-sectional view of a modification of the electrode shown in FIG. 3, where the shielding portion of the electrode is generally ovate.

DESCRIPTION OF PREFERRED EMBODIMENTS

In FIG. 1, a system is depicted schematically for filtering fibers and particulates from a gas stream. Such a system might be used, for example, in filtering cotton fibers and dust from the atmosphere of a textile factory. It is conventional to pass the fiber-laden and particulate-laden gas stream first through a fiber separator 10, which removes fibers in gross quantity from the gas stream. Several kinds of fiber separators are commercially available that could be used in a system according to the present invention.

The fiber separator 10, if working properly, removes the major portion of the fibers from the gas stream. However, a certain portion of the fibers, particularly the shorter fibers, escapes removal from the gas stream by the fiber separator 10. Respirable particulates (e.g., cotton dust) in the gas stream pass through the fiber separator 10 to a significant extent. These particulates, as well as the fibers that are not removed by the fiber separator 10, are carried by the gas stream through a corona discharge region established by a corona charging apparatus 20. A significant portion of the particulates and fibers passing through the corona discharge region acquire an electric charge, and are subsequently removed from the gas stream by deposition onto an electrostatic filter medium 30.

The filter medium 30 could be, e.g., a bed of randomly oriented electrically resistive fibers, an electrically resistive woven or knitted fabric, or a mat of agglomerated fibers collected from the gas stream onto a foraminous support structure disposed in the gas stream. Among the fabrics tested and found suitable for the practice of this invention is a nylon fabric approximately ¼ inch thick, separated from a metallic supporting screen by an open-mesh polypropylene spacing structure approximately ¼ inch thick. A polypropylene fabric approximately ¼ inch thick, isolated from a metallic supporting screen by an open-mesh polypropylene spacing structure approximately ¼ inch thick, has also been shown to be effective. The filter medium 30 could advantageously be mounted on the cylindrical wall of a drum filter conventionally disposed to receive the outflow from the corona charging apparatus 20.

The corona charging apparatus 20 comprises a high-voltage electrode, or a plurality of such electrodes, disposed in the gas stream. A sufficiently high voltage is applied to these electrodes to cause ionization of the gas in the immediate vicinity of each of the electrodes, thereby generating a corona discharge adjacent each of the electrodes. The magnitude of the voltage applied to the corona-generating electrodes depends upon the geometry of the electrodes and the ionization potential of the gas. A discussion of the physics of the corona discharge is provided in standard texts such as *Industrial Electrostatic Precipitation* by Harry J. White, (Addison-Wesley Publishing Company, Inc., 1963), pages 83–89.

In general, ionization of a gas in the region adjacent a high-voltage electrode first occurs adjacent the "sharpest" edge or point of the electrode—i.e., adjacent that portion of the electrode having the smallest radius of curvature. Thus, in order to generate a corona discharge in a fiber- and particulate-laden gas stream at manageable voltages (typically in the 5 to 20 kilovolt range), it is customary to use fine wires (e.g., of 10-mil outside diameter) as the discharge electrodes. The corona discharge voltage for air in the vicinity of a 10-mil tungsten wire electrode of circular cross section is about 10 kilovolts.

It has been found that fibers present in a particulate-laden gas stream (e.g., due to imperfect removal of fibers by an upstream mechanical fiber separator) tend to become entangled around 10-mil corona discharge wires. Eventually, the entangled fibers form an electrically resistive sheath covering large portions of such an electrode, thereby increasing the electrical power required to maintain a corona discharge adjacent the electrode. Increasing the power applied to the corona-generating electrodes in a filtration system, however, increases the likelihood of sparking and the concomitant possibility of fire. In certain applications, the build-up of a fibrous sheath on the corona-generating electrodes of a corona charging apparatus can also significantly impede gas flow through the corona charging apparatus.

In the course of an investigation on the entanglement of fibers from a gas stream on high-voltage corona discharge electrodes, it was discovered that such fiber entanglement occurs for the most part when the length of the fibers is greater than the cross-sectional perimeter of the electrode in a plane parallel to the direction of flow of the gas stream. It was further discovered that attachment of fibers from the gas stream to the electrode does not occur when the cross-sectional perimeter of the electrode is larger than the length of the fibers. Thus, for example, the attachment of cotton fibers (whose average length is in the order of 0.25 inch) to high-voltage electrode wires can be substantially prevented by using electrode wires of 0.5-inch diameter. However, the voltage required on a 0.5-inch diameter electrode wire to cause corona discharge in air is on the order of 50 kilovolts. Such a high voltage would necessarily require a very large distance (on the order of 5 to 10 inches) between each discharge electrode and the ground electrode in order to prevent continuous arcing.

In accordance with the present invention, a high-voltage electrode to be used in the corona charging apparatus 20 is configured to have a shielding portion, and a corona discharge portion that is shielded from fibers in the gas stream by the shielding portion. The ratio of the radius of curvature of the shielding portion to the radius of curvature of the corona discharge portion in a plane parallel to the gas stream is on the order of 2000, so that corona discharge occurs in a region that is effectively shielded from fibers carried by the gas stream.

In an embodiment of the invention as shown in FIG. 2, the corona discharge electrode 21 has a shielding portion 22 facing upstream and a corona discharge portion 23 facing downstream. The electrode 21 is mounted in the gas stream by any conventional technique, which is not part of the present invention. The shielding portion 22 can be a hollow tubular structure having an outside diameter of, e.g., 0.5 inch and an annular thickness of, e.g., 30 mils. Attached to the tubular shielding portion 22 as by spot welding or soldering is a vane-like corona discharge portion 23, which extends radially outward from the elongate axis of the tubular shielding portion 22 for, e.g., 0.25 inch and has a thickness of, e.g., 5 mils.

As indicated in FIG. 2A, the cross-sectional perimeter of the electrode 21 is greater than the circumference of the shielding portion 22 by preferably twice the width of the corona discharge portion 23. For a shielding portion 22 fabricated from 0.5-inch O.D. tubing and a corona discharge portion comprising a 0.25-inch wide vane, the total cross-sectional perimeter of the electrode 21 is approximately 2.1 inches, which is greater than the maximum length usually encountered for cotton fibers, (i.e., about 1.25 inches).

The electrode 21 is mounted in the gas stream so that the shielding portion 22 presents a surface having a relatively high radius of curvature to the on-coming gas stream, while the corona discharge portion 23 extends outward from the shielding portion 22 in the downstream direction.

Alternatively, as shown in FIG. 2B, the shielding portion indicated by the reference number 24 could be of a generally ovate configuration, with the vane-like corona discharge portion 23 being attached along the narrow side of the shielding portion 24. In this way, the overall configuration of the shielding portion 24 presents a streamlined profile to the on-coming gas stream.

In either of the embodiments shown in FIGS. 2A and 2B, the corona discharge portion 23 is effectively shielded from entanglement with fibers in the gas stream. The voltage that must be applied to the electrode 21 to initiate corona discharge is relatively low (i.e., on the order of 10 kilovolts) due to the small radius of curvature of the edge of the corona discharge portion 23, while the relatively large cross-sectional perimeter of the electrode 21 prevents entanglement of fibers on the corona discharge portion 23.

In an alternative embodiment of the invention as shown in FIG. 3, the corona discharge electrode 25 has an elongate shielding portion 26 facing upstream, and a corona discharge portion comprising a plurality of needle-like projections 27 extending outward from the shielding portion 26 in the downstream direction. A cross-sectional perimeter of the electrode 25 at each point where a corona discharge is generated is shown in FIG. 3A.

In a further alternative embodiment, as shown in FIG. 3B, the shielding portion 28 could be of generally ovate configuration, with the needle-like projections 27 extending outward from the narrower downstream side of the ovate shielding portion 28.

Other particular configurations of corona discharge electrodes according to the present invention are possible. A corona discharge electrode according to this invention is elongate, and has a shielding portion with a radius of curvature that is larger than the radius of curvature of the corona discharge portion in a plane perpendicular to a direction of elongation of the electrode, where the perimeter around the electrode in that plane is greater than the length (or a selected fraction of the greatest length) of the fibers present in the gas stream. Consequently, the above description of preferred embodiments is to be construed as merely illustrative of the invention. The invention is defined by the following claims.

What is claimed is:

1. A fiber-rejecting corona discharge electrode for imparting electric charge to particulates in a gas stream, comprising:

an arcurate shielding member for positioning within the path of a gas stream to confront the direction of flow of gases along said path;

a corona discharge member having a radius of curvature about a terminal end, the corona discharge member being connected to the shielding member and projecting radially outwardly from the elongate axis of the shielding member such that when placed in said path the corona discharge member is downstream from the shielding member, the radius of curvature of the shielding member being larger than the radius of curvature of the corona discharge member in a plane perpendicular to the direction of elongation of the electrode, and the cross-sectional perimeter around the connected shielding member and corona discharge member being greater than 1.25 inches.

2. The fiber-rejecting corona discharge electrode of claim 1, wherein:

the shielding member is of circular cross-section; and the cross-sectional perimeter around the connected shielding member and corona discharge member is greater than the circumference of the shielding member by more than twice the width of the corona discharge member.

3. The fiber-rejecting corona discharge electrode of of claim 2, wherein:

the corona discharge member is in the form of a vane.

4. The fiber-rejecting corona discharge electrode of claim 2, wherein:

the corona discharge member comprises a needle-like projection.

5. The fiber-rejecting corona discharge electrode of claim 2, wherein:

the corona discharge member comprises a plurality of needle-like projections spaced linearly apart from each other along the shielding portion.

6. The fiber-rejecting corona discharge electrode of claim 1, wherein:

the ratio of curvature of the shielding member to the radius of curvature of the corona discharge member is approximately 2000.

7. The fiber-rejecting corona discharge electrode of claim 6, wherein:

the shielding member is of circular cross-section; and the cross-sectional perimeter around the connected shielding member and corona discharge member is greater than the circumference of the shielding member by more than twice the width of the corona discharge member.

8. The fiber-rejecting corona discharge electrode of claim 7, wherein:

the corona discharge member comprises a plurality of needle-like projections spaced linearly apart from each other along the shielding portion.

9. The fiber-rejecting corona discharge electrode of claim 6, wherein:

the corona discharge member is in the form of a vane.

10. The fiber-rejecting corona discharge electrode of claim 6, wherein:

the corona discharge member comprises a needle-like projection.

11. The fiber-rejecting corona discharge electrode of claim 1, wherein:

the shielding member is a right cylinder tube.

12. The fiber-rejecting corona discharge electrode of claim 11, wherein:

the corona discharge member is in the form of a vane.

13. The fiber-rejecting corona discharge electrode of claim 11 wherein:

the corona discharge member comprises a needle-like projection.

14. The fiber-rejecting corona discharge electrode of claim 11, wherein:

the corona discharge member comprises a plurality of needle-like projections spaced linearly apart from each other along the shielding member.

15. A system for filtering fibers and particulates from a gas stream comprising:

a fiber separator for positioning in the path of a gas stream for removing fibers in gross quantities from said gas stream;

a corona charging apparatus for positioning within said path downstream of the fiber separator for imparting electric charge to particulates in said gas stream and to fibers that escape removal from said gas stream by the fiber separator, the corona charging apparatus including a fiber-rejecting corona discharge electrode having a shielding member connected to a corona discharge member such that said shielding member faces generally upstream and said corona discharge member faces generally downstream when positioned in the path of said gas stream such that the shielding member shields said corona discharge member from entanglement with fibers in said gas stream, the radius of curvature of said shielding member being larger than the radius of curvature of said corona discharge member in a plane perpendicular to the direction of elongation of the electrode, and the cross-sectional perimeter around said electrode being greater than 1.25 inches; and an electro-static filter medium positioned downstream of the corona charging apparatus for removing electrically charged particulates and fibers from said gas stream.

16. The system of claim 15, wherein;

said corona discharge member is vane-like and extends from said shielding member along said direction of elongation.

17. The system of claim 15, wherein;

said corona discharge member comprises a needle-like projection extending from said shielding member.

18. The system of claim 15, wherein;

said corona discharge member comprises a plurality of needle-like projections spaced linearly apart from each other along said direction of elongation.

19. The system of claim 15, wherein;

said electro-static filter medium comprises a nylon fabric.

20. The system of claim 15, wherein;

said electro-static filter medium comprises a polypropylene fabric.

* * * * *